US005923131A

United States Patent [19]

Ishii

[11] Patent Number: 5,923,131

[45] **Date of Patent: *Jul. 13, 1999**

[54] COMPENSATING DEVICE FOR RASTER DISTORTION OF CRT

[75] Inventor: Akitsugu Ishii, Osaka, Japan

[73] Assignee: Matsushita Electronics Corporation, Osaka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/820,489

[22] Filed: Mar. 18, 1997

[30] Foreign Application Priority Data

Mar. 21, 1996 [JP] Japan ..... 8-065020

[51] Int. Cl.[6] ..... G09G 1/04

[52] U.S. Cl. ..... 315/370

[58] Field of Search ..... 315/370; 313/440, 313/431; 335/210

[56] References Cited

U.S. PATENT DOCUMENTS 4,992,697 2/1991 Penninga et al. ..... 313/440

FOREIGN PATENT DOCUMENTS 58-220342 12/1983 Japan .
62-170133 7/1987 Japan .
63-108151 7/1988 Japan .
2-204947 8/1990 Japan .
3-6176 1/1991 Japan .
4-188543 7/1992 Japan .
6-31272 4/1994 Japan .

OTHER PUBLICATIONS

"Testing Methods for Cathode–Ray Tubes with Deflection Yoke", *Technical Committee on Electronic Display Devices*, pp. 22–25, 31–32 (with partial translation).

Communicarion from European Patent Office and attached Search Report.

*Primary Examiner*—Gregory C. Issing
*Attorney, Agent, or Firm*—Merchant, Gould, Smith, Edell, Welter & Schmidt, P.A.

[57] ABSTRACT

A compensating device for raster distortion is provided, which can compensate a raster distortion, preferably including an inner pincushion distortion, by a simple and inexpensive configuration. The compensating device comprises an electromagnet and a pair of permanent magnets. The electromagnet is disposed outside of a deflection yoke and at a center portion of a side of a beam-deflection area, and generates magnetic poles in the direction along the side. The pair of permanent magnets are disposed beyond the ends of the side, and generate magnetic poles aligned with the magnetic poles of the electromagnet.

12 Claims, 6 Drawing Sheets

COMPENSATING DEVICE FOR RASTER DISTORTION OF CRT

BACKGROUND OF THE INVENTION

The present invention relates to a compensating device for raster distortion of a cathode-ray tube apparatus that is used in a television set or a computer display.

Recently, a screen panel of a cathode-ray tube apparatus is required to be substantially flat. One of the problems involved with the flatness of the screen panel is a raster distortion. Though the shape of the raster on the screen must be an exact rectangle for displaying a high quality image, in practice it can be a distorted shape such as a trapezoid or a pincushion due to an influence of a deflection yoke, an electron gun or other members of the cathode-ray tube apparatus. Compensation for such raster distortion is usually performed by controlling the current supplied to a deflection coil using a compensation circuit provided to the display set, as described in Japanese laid-open patent application (Tokukai-Hei) 3-6176 or 6-31272, for example.

Even if an exact rectangular shape of the raster is obtained after such compensation for a raster distortion, the raster sometimes still has an inner distortion as shown in FIGS. 6A and 6B, for example. In these Figures, the left and right sides as well as the upper and lower sides of the raster are straight and parallel, but the middle portions 20' and 20" of the raster are distorted to a pincushion shape. This type of distortion is called "Inner pincushion distortion" hereinafter. FIG. 6A shows a horizontal inner pincushion distortion where the middle portion 20' including a center vertical axis 12 is distorted to a pincushion shape. FIG. 6B shows a vertical inner pincushion distortion where the middle portion 20" including a center horizontal axis 11 is distorted to a pincushion shape. A testing method of such inner pincushion distortions is described in "Testing Methods for Cathode-Ray Tubes with Deflection Yoke" as a Standard of Electronic Industries Association of Japan, ED-2101B revised on February, 1995, Section 7.8.

The inner pincushion distortion mentioned above can be compensated by a method disclosed in Japanese laid-open patent application, Tokukai-Hei 4-188543 or Jitsukai-Sho 63-108151. In this method, an inner magnetic shield member in a glass bulb of the cathode-ray tube is cut by a circular curve at upper and lower sides or left and right sides of the rectangular opening that is near to an electron gun such that the end of the cut side retreats at the middle portion. Thus, a vertical or a horizontal magnetic field is distorted, so that the inner pincushion distortion is compensated.

However, the above mentioned method for compensating the inner pincushion distortion has some disadvantages. A shield effect by the inner magnetic shield member may be weakened due to the change in shape of the shield member. Mechanical strength also may be weakened due to the cutouts of the shield member.

In addition, a cost for the compensation of the raster distortion may be increased since different means are required for the compensation for the different raster distortions such as the trapezoid distortion and the inner pincushion distortion. A compensation circuit that is added to the display set for the raster distortion such as the trapezoid distortion is complicated and expensive.

A purpose of the present invention is to provide a compensation device for a raster distortion, which can compensate the raster distortion including the inner pincushion distortion at a low cost and easily.

SUMMARY OF THE INVENTION

A compensating device according to the present invention comprises an electromagnet disposed around a deflection yoke and disposed at a center portion of at least one side of upper, lower, right and left sides of a substantially rectangular section of a beam-deflection area, the electromagnet generating magnetic poles in the direction along the side on which it is located; a driver for the electromagnet; and a pair of permanent magnets disposed beyond ends of the side, the magnetic poles of the permanent magnets being aligned substantially with the magnetic poles of the electromagnet.

The compensating device having the above mentioned structure generates a combined magnetic field between the electromagnet and the permanent magnets. As a result, an electron beam in the combined magnetic field is given a Lorenz force in the direction perpendicular to the magnetic field and the electron beam, so that the raster distortion can be compensated.

It is preferable that the driver provide the electromagnet with a current synchronizing with a vertical deflection current when the electromagnet is disposed at a center portion of at least one side of the upper and lower sides of the beam-deflection area. If the current for magnetizing the electromagnet is a direct current, intensity of the electromagnet is constant, so that the Lorenz force is the strongest at the nearest to the electromagnet, e.g., the nearest to the upper side of the beam-deflection area. If the magnetizing current increases along with the vertical deflection angle, the Lorenz force is further strengthened at a nearer position to the upper side, so that the raster distortion is compensated more effectively.

For the same reason, it is also preferable that the driver provide the electromagnet with a current synchronizing with a horizontal deflection current when the electromagnet is disposed at a center portion of at least one side of the right and left sides of the beam-deflection area.

It is preferable that the driver can change the direction of the current for magnetizing the electromagnet so that a magnetic polarity (i.e., directions of magnetic poles) of the electromagnet is reversible. It is also preferable that the polarities of the permanent magnets are reversible. By changing magnetic polarities of the electromagnet and/or the permanent magnets, the compensating device can be applied easily to various distortions in the upper, lower, right or left side.

Adding to the above mentioned structure, another configuration of the compensation device according to the present invention further comprises a plurality of electromagnets disposed between the electromagnet at the center portion of the side and ends of the side, and magnetic poles of the electromagnets and the permanent magnets are aligned substantially.

According to the above mentioned configuration, the center electromagnet and the plurality of electromagnets disposed between the center magnet and ends of the side generate combined magnetic fields between them, which gives a Lorenz force to electrons in the combined magnetic fields. Thus, the inner pincushion distortion is compensated adequately.

In the above mentioned configuration too, it is preferable that the driver provide the electromagnets with a current synchronizing with the vertical deflection current when the electromagnets are disposed along at least one side of the upper and lower sides of the beam-deflection area, and that the driver provide the electromagnets with a current synchronizing with the horizontal deflection current when the electromagnets are disposed along at least one side of the right and left sides of the beam-deflection area. It is also preferable that the polarities of electromagnets and/or the permanent magnets are reversible.

The deflection yoke with the compensating device for a raster distortion according to the present invention comprises a horizontal deflection coil; a vertical deflection coil disposed around the horizontal deflection coil; a magnetic core disposed around the vertical coil; and the compensating device disposed around the magnetic core.

The cathode-ray tube with the compensating device for a raster distortion according to the present invention comprises a neck portion housing an electron gun; a funnel portion extending from the neck portion; a face panel portion connected to the funnel portion so as to close the opening of the funnel portion, the face panel portion having a phosphor screen on its inner surface; a deflection yoke disposed around the boundary of the neck portion and the funnel portion; and the compensating device disposed around the deflection yoke.

DETAILED DESCRIPTION OF THE PREFERRED EMBODIMENTS

Figure 1:
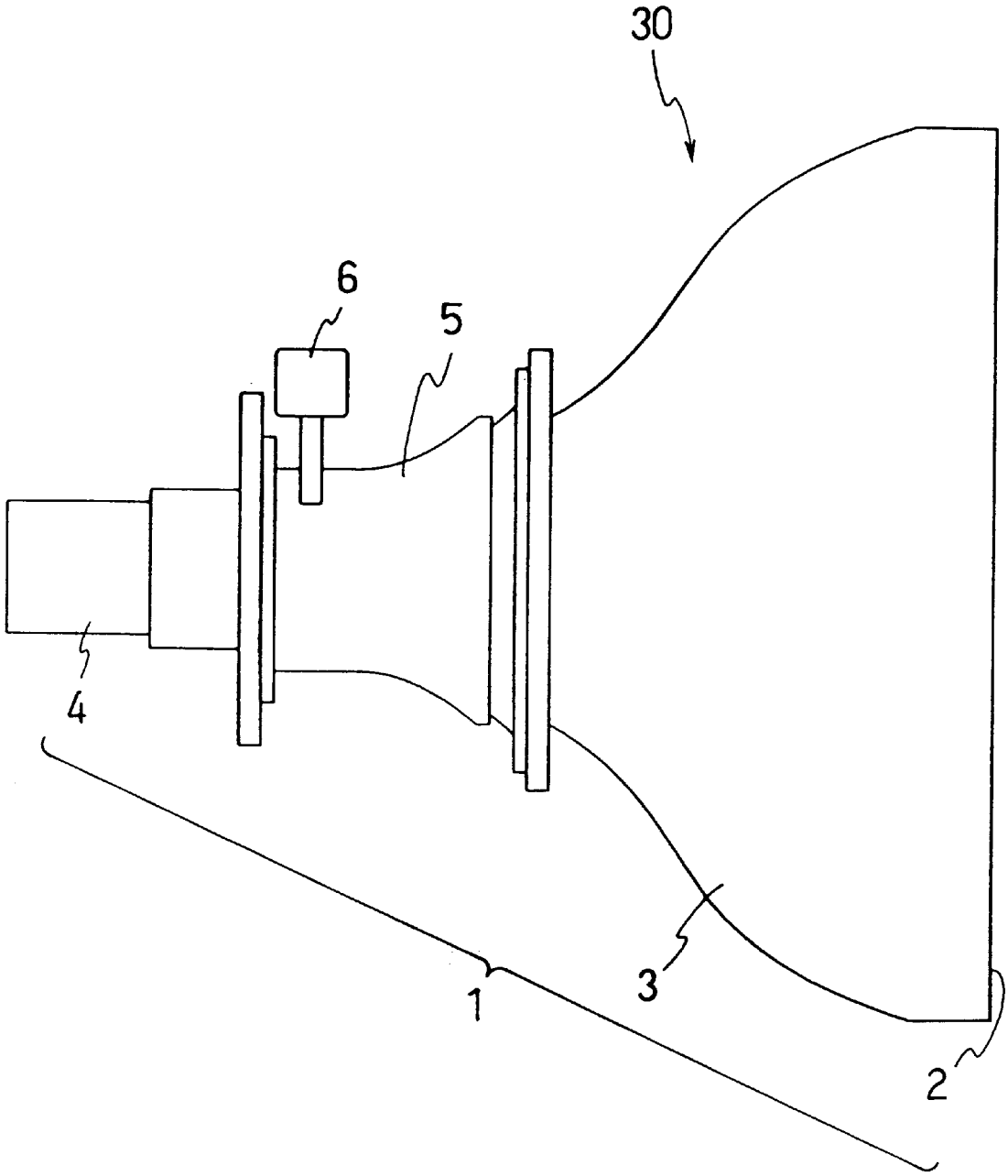
FIG. 1 is a side view of a cathode-ray tube with a compensating device for a raster distortion according to the present invention.

An example of a cathode-ray tube apparatus 30 with a compensating device for a raster distortion according to the present invention is shown in FIG. 1. In this Figure, the cathode-ray tube 1 comprises a face panel portion 2 having a screen whose inside surface is coated with phosphors, a funnel portion 3 and a neck portion 4. The neck portion 4 houses an electron gun that emits three electron beams, though it is not illustrated in the Figure. A deflection yoke 5 is disposed around a boundary portion between the funnel portion 3 and the neck portion 4. A compensating device 6 for a raster distortion is disposed at the upper side of the deflection yoke 5. However, the location of the compensating device is not limited to the upper side of the deflection yoke 5 as shown in FIG. 1. The compensating device 6 may be disposed along at least one location of upper, lower, right (on the side behind the sheet from the reader in FIG. 1) and left (on the side facing the reader in FIG. 1) sides of the deflection yoke 5 in accordance with the shape of a raster distortion to be compensated.

Figure 2:
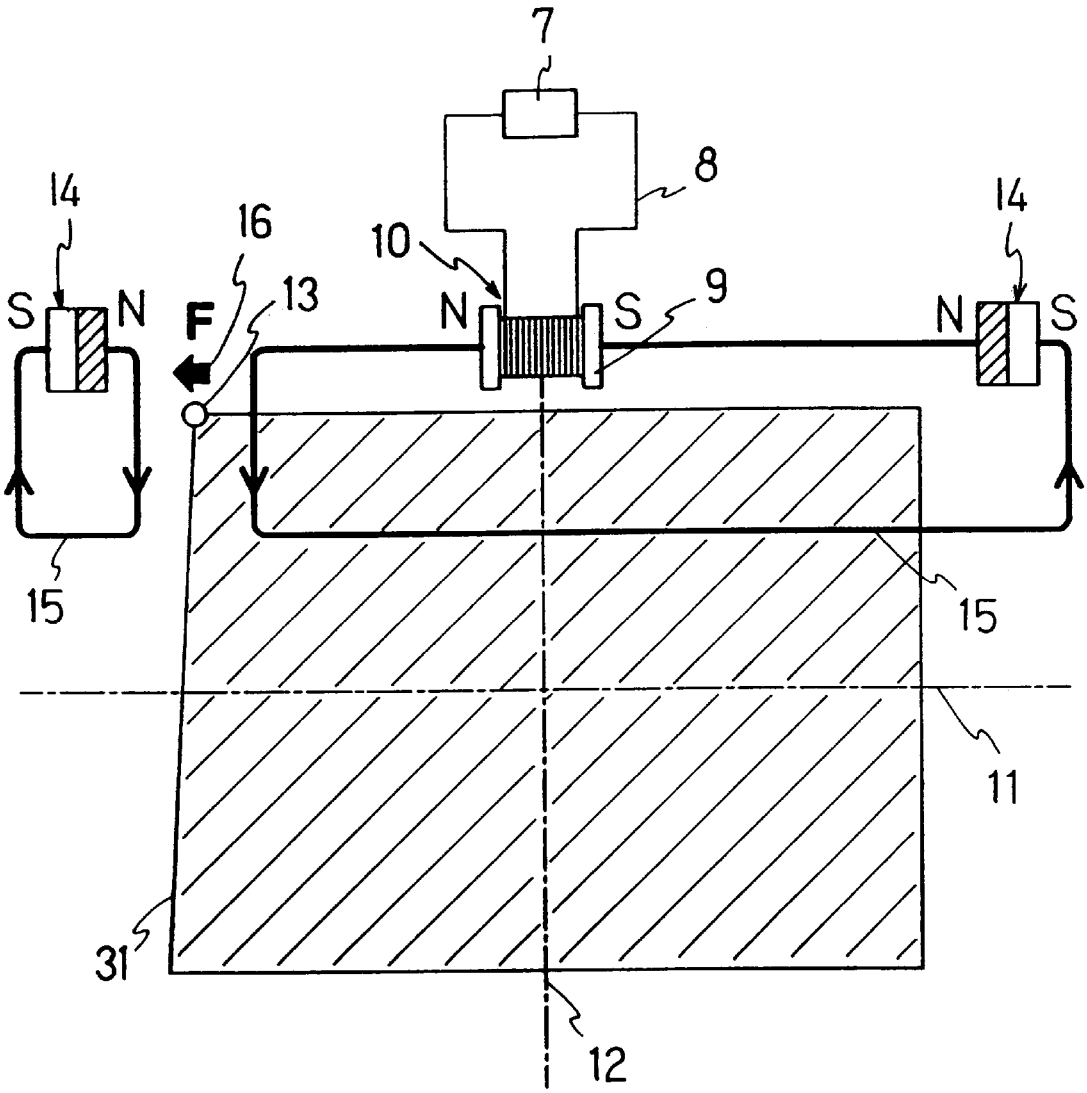
FIG. 2 illustrates the configuration and principle of a first embodiment of the compensating device for a raster distortion according to the present invention.
Figure 3:
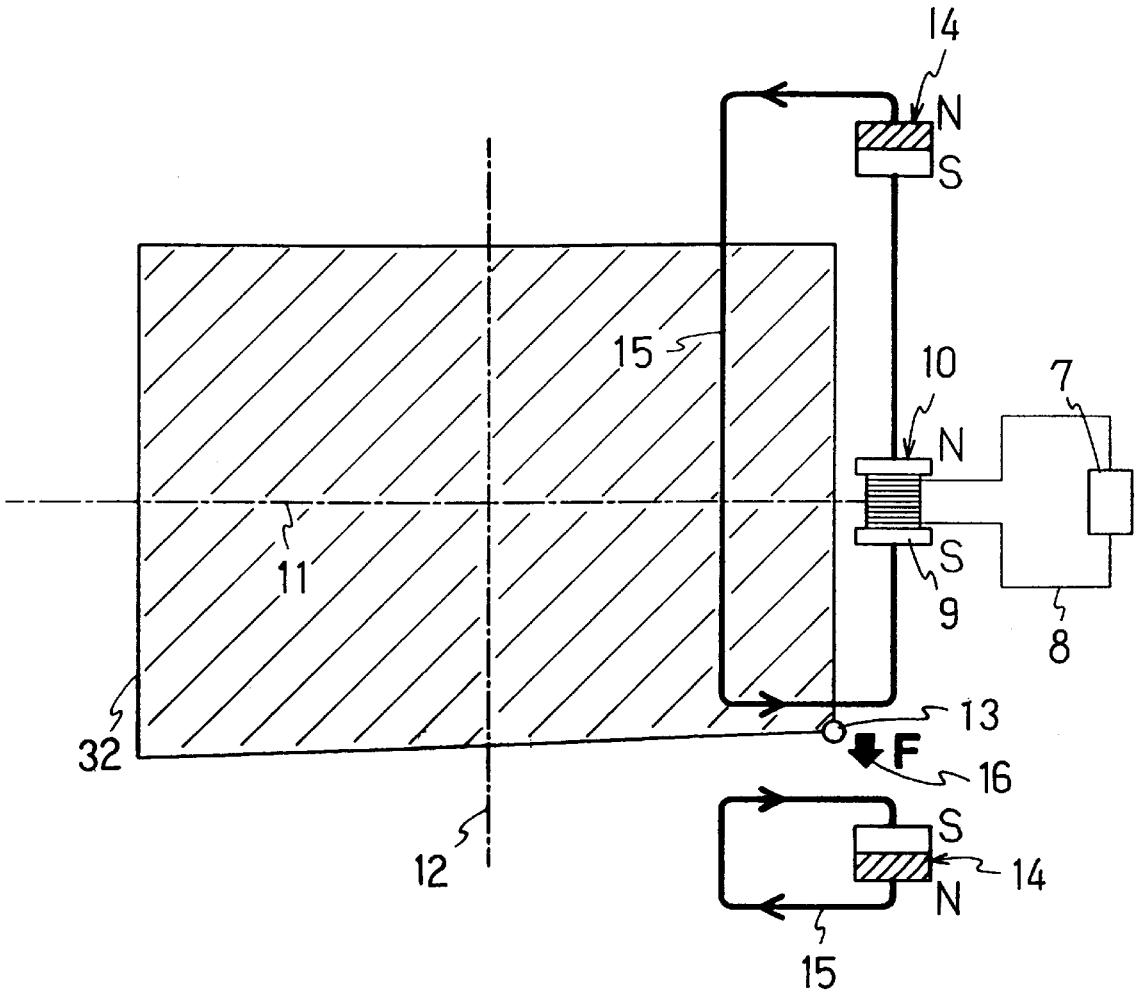
FIG. 3 illustrates the configuration and principle of a second embodiment of the compensating device for a raster distortion according to the present invention.
Figure 4:
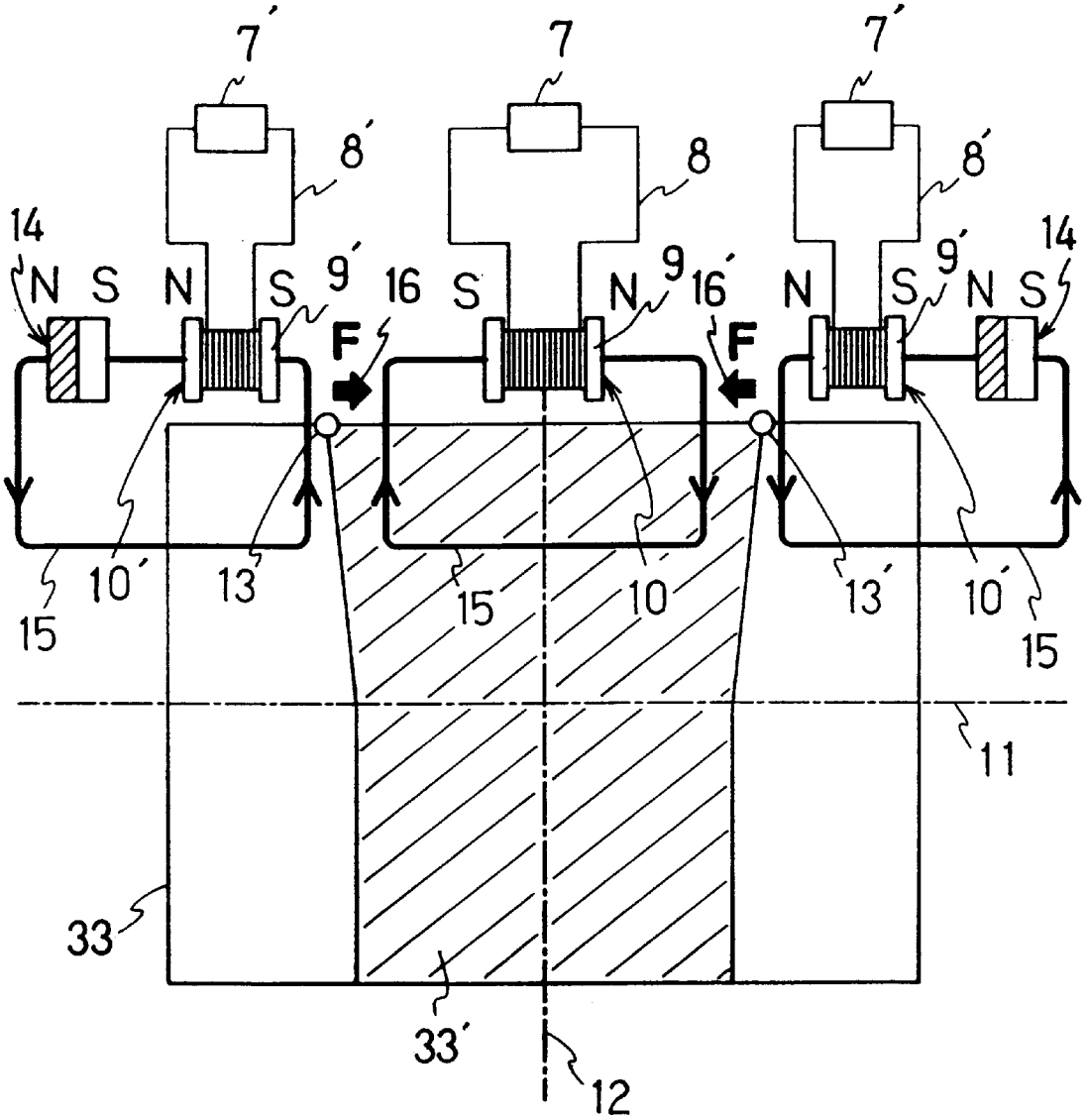
FIG. 4 illustrates the configuration and principle of a third embodiment of the compensating device for a raster distortion according to the present invention.
Figure 5:
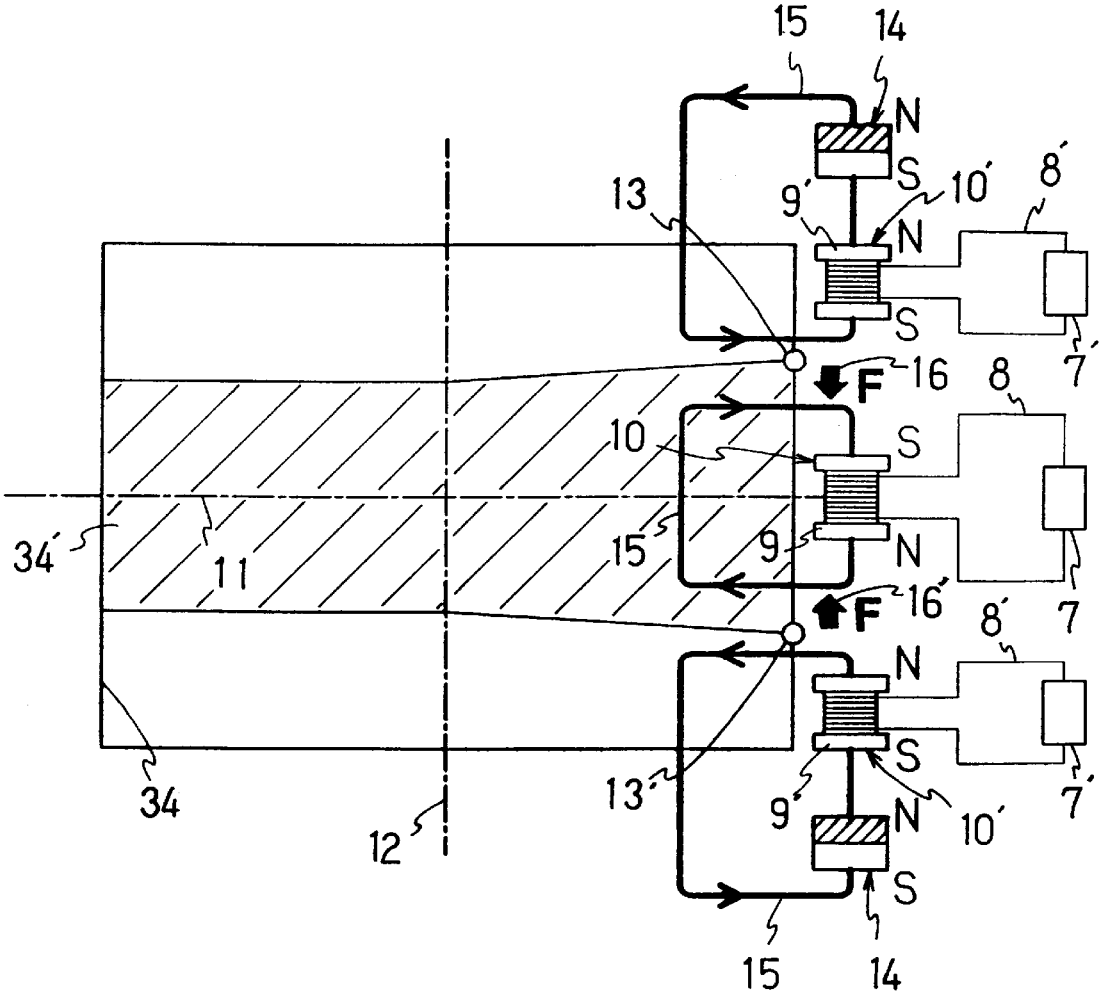
FIG. 5 illustrates the configuration and principle of a fourth embodiment of the compensating device for a raster distortion according to the present invention.
Figure 6A:
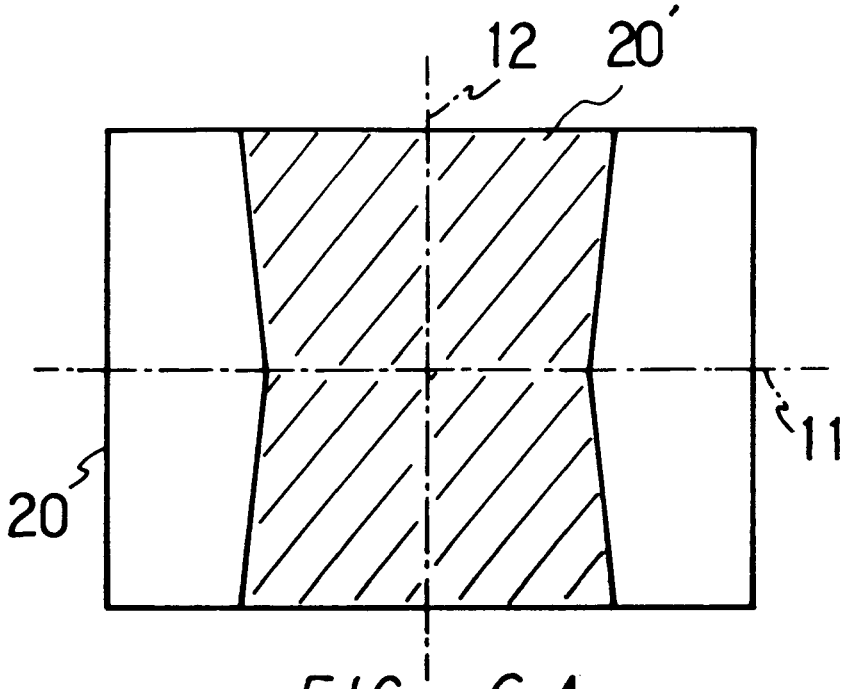
FIG. 6 A (PRIOR ART)
FIG. 6A illustrates a horizontal inner pincushion distortion in the prior art.
Figure 6B:
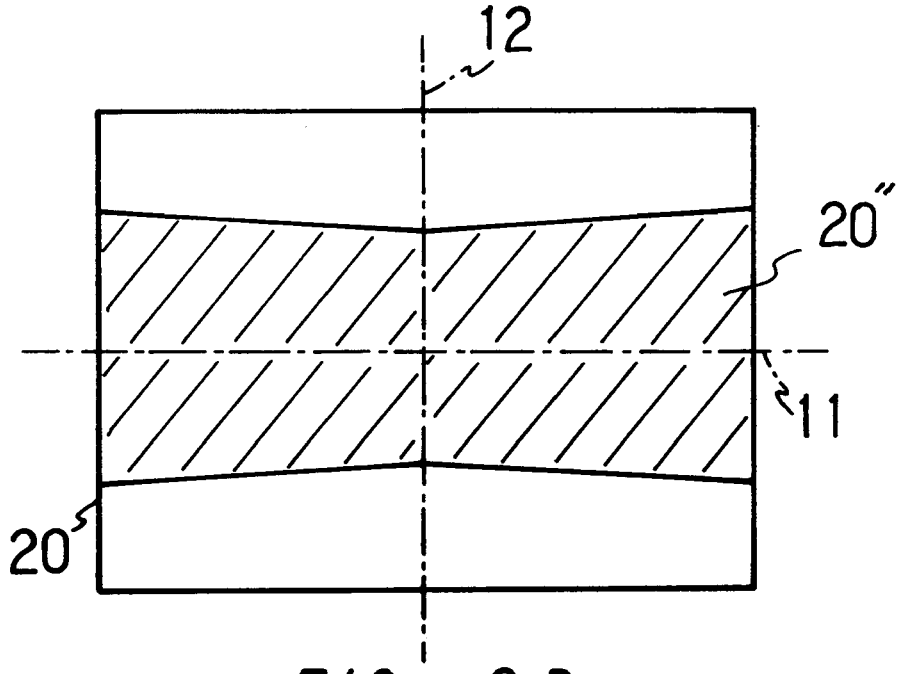
FIG. 6 B (PRIOR ART)
FIG. 6B illustrates a vertical inner pincushion distortion in the prior art.

FIG. 2 shows the configuration and principle of a first embodiment of the compensating device for a raster distortion. FIG. 2 is a view from the face panel 2. The following FIGS. 3–5 are the same as FIG. 1 regarding the view direction.

The compensating device for a raster distortion comprises electromagnet 10, its driving circuit 7 (i.e., means for driving the electromagnet 10) and a pair of permanent magnets 14. The electromagnet 10 includes a magnetic core 9 and a wire 8 wound around the core 9. The electromagnet 10 is disposed at a center portion (on the center vertical axis 12) of the upper side of the substantially rectangular section 31 that is a deflection area of the electron beam, and generates magnetic poles in the direction along the upper side as shown in FIG. 2. The shape of this beam-deflection area 31 is similar to the raster shape on the screen. Therefore, when the left side of the beam-deflection area 31 leans inward as shown in FIG. 2, there is a similar trapezoid distortion in the raster on the screen.

The ends of the wire 8 of the electromagnet 10 are connected to the driving circuit 7, which supplies a magnetizing current to the electromagnet 10 synchronizing with the vertical deflection current. For example, a saw-tooth wave current, which is similar to the vertical deflection current increasing along with the vertical deflection angle, is supplied to the electromagnet 10. The driving circuit 7 is not always required to be placed together with the electromagnet 10 around the deflection yoke; it may be apart from the electromagnet 10.

In FIG. 2, the electromagnet 10 is driven in the upper half of the beam-deflection area 31 so as to generate the south pole at the right and the north pole at the left of the electromagnet 10. A pair of permanent magnets 14 are disposed beyond the ends of the upper side of the beam-deflection area 31. The magnetic poles of the pair of permanent magnets 14 are substantially aligned with the magnetic poles of the electromagnet 10. Both permanent magnets 14 have the north poles at inner ends facing the electromagnet 10 and the south poles at outer ends.

The electromagnet 10 and the pair of permanent magnets 14 generate a vertical combined magnetic field such as shown by a magnetic flux 15 in FIG. 2, which is strengthened at the left and weakened at the right of the electromagnet 10. Therefore, an electron beam 13 in the upper half of the beam-deflection area 31 is given a leftward (i.e., outward) Lorenz force 16 at the upper-left area of the beam-deflection area 31, and is not given such a Lorenz force at the upper-right area of the beam-deflection area 31. In addition, the magnetizing current supplied to the electromagnet 10 from the driving circuit 7 increases along with the vertical deflection angle as mentioned before. Therefore, the electron beam that is near to the left side of the beam-deflection area 31 is given a stronger Lorenz force if the beam is nearer to the upper side of the beam-deflection area 31. As a result, the inclination of the left side of the beam-deflection area 31 is compensated, so that the trapezoid distortion of the raster on the screen is compensated adequately.

The magnetizing current, which the driving circuit 7 supplies to the electromagnet 10, is not always required to be the saw-tooth wave current increasing along with the vertical deflection angle as mentioned before. It may be a direct current, for example. In this case, though the compensation efficiency may decrease, the trapezoid distortion shown in FIG. 2 is compensated since electron beams that are near to the upper side of the beam-deflection area 31 (that is near to the electromagnet 10) are given a stronger Lorenz force. In both cases, the distorted beam-deflection area 31 and the distorted raster on the screen can be compensated to be a rectangular shape by controlling the magnetizing current supplied to the electromagnet 10 in accordance with a distortion level of the trapezoid distortion.

For example, a variable resistor may be connected to the electromagnet 10 in series or parallel, and the magnetizing current for the electromagnet 10 is controlled by adjusting the variable resistor.

In FIG. 2, if the direction of the magnetizing current for the electromagnet 10 is changed, the magnetic polarity of the electromagnet 10 is changed so that the north pole is at the right and the south pole is at the left of the electromagnet 10. In this case, the vertical combined magnetic field between the electromagnet 10 and the permanent magnets 14 is weakened at the left and strengthened at the right of the electromagnet 10, oppositely to FIG. 2. As a result, electron beams at the upper-right area are given a leftward (i.e., inward) Lorenz force, so that a trapezoid distortion, in which the right side leans outward, can be compensated effectively.

In FIG. 2 again, if both of the magnetic polarities of the pair of permanent magnets 14 are changed so that the south poles are at the inner ends and the north poles are at the outer ends of the permanent magnets 14, the vertical combined magnetic field, which is strengthened at the right or the left of the electromagnet 10 in accordance with the polarity of the electromagnet 10, has the upward direction opposite to FIG. 2. As a result, the Lorenz force given to the electron beam has the rightward direction, opposite to FIG. 2. Thus, a trapezoid distortion, in which the left side leans outward or the right side leans inward, can be compensated effectively. Though the polarity of the permanent magnet 14 can be changed by resetting the magnet 14 after changing its position by 180 degrees, it can be changed more easily if the permanent magnet 14 is fixed to a holder (not shown in the Figure) that can pivot on the axis perpendicular to the plane of FIG. 2.

Similarly, it can be understood that a trapezoid distortion, in which the right and left sides lean inward, can be compensated, if the polarity of the left permanent magnet 14 is changed without changing the polarity of the right permanent magnet 14. In this state, if the polarities of the electromagnet 10 and the permanent magnets 14 are changed simultaneously, a trapezoid distortion, in which the right and left sides lean outward, can be compensated effectively.

In the above mentioned embodiment, the electromagnet 10 and the permanent magnets 14 are disposed near the upper side of the beam-deflection area 31. However, it may be apparent to a person skilled in the art that the same effect can be obtained if they are disposed near the lower side of the beam-deflection area 31. A trapezoid distortion, in which the right and/or left sides lean inward or outward, can be compensated by giving a Lorenz force to the electron beam at the lower-left or lower-right area of the beam-deflection area 31, too. In this case, the compensating device 6 for the raster distortion is attached to the lower side of the deflection yoke 5 in FIG. 1.

A second embodiment of the compensation device for a raster distortion according to the present invention is shown in FIG. 3. In this embodiment, the compensation device for a raster distortion, which includes the same members as the first embodiment, is attached behind the deflection yoke 5 as shown in FIG. 1, that is to the right of the deflection yoke 5 when viewing from the face panel 2 of the cathode-ray tube 1. The electromagnet 10 is disposed at a center portion (on the center horizontal axis 11) of the right side of a beam-deflection area 32, and generates magnetic poles in the direction along the right side as shown in FIG. 3. The shape of this beam-deflection area 32 is similar to the raster shape on the screen. Therefore, when the lower side of the beam-deflection area 32 rises at the right as shown in FIG. 3, there is a similar trapezoid distortion in the raster on the screen.

The ends of the wire 8 of the electromagnet 10 are connected to the driving circuit 7, which supplies a current to the electromagnet 10 synchronizing with the horizontal deflection current. For example, a saw-tooth wave current, which is similar to the horizontal deflection current increasing along with the horizontal deflection angle, is supplied to the electromagnet 10. The driving circuit 7 is not always required to be placed together with the electromagnet 10 around the deflection yoke; it may be apart from the electromagnet 10.

As shown in FIG. 3, the electromagnet 10 is magnetized in the right half of the beam-deflection area 32 so as to generate the south pole at the lower side and the north pole at the upper side of the electromagnet 10. A pair of permanent magnets 14 are disposed beyond the ends of the right side of the beam-deflection area 32. The magnetic poles of the pair of permanent magnets 14 are substantially aligned with the magnetic poles of the electromagnet 10. Both permanent magnets 14 have the south poles at the inner ends facing the electromagnet 10 and the north poles at the outer ends.

The electromagnet 10 and the pair of permanent magnets 14 generate a horizontal combined magnetic field such as shown by a magnetic flux 15 in FIG. 3, which is strengthened at the lower end and weakened at the upper end of the electromagnet 10. Therefore, an electron beam 13 in the right half of the beam-deflection area 32 is given a downward (i.e., outward) Lorenz force 16 at a lower-right area of the beam-deflection area 32, and is not given such a Lorenz force at an upper-right area of the beam-deflection area 32. In addition, the magnetizing current supplied to the electromagnet 10 from the driving circuit 7 increases along with the horizontal deflection angle as mentioned before. Therefore, the electron beam that is near to the lower side of the beam-deflection area 32 is given a stronger Lorenz force if the beam is nearer to the right side of the beam-deflection area 32. As a result, the inclination of the lower side of the beam-deflection area 32 is compensated, so that the trapezoid distortion of the raster on the screen is compensated adequately.

The magnetizing current, which the driving circuit 7 supplies to the electromagnet 10, is not always required to be the saw-tooth wave current increasing along with the horizontal deflection angle as mentioned before. It may be a direct current, for example. In this case, though the compensation efficiency may decrease, the trapezoid distortion shown in FIG. 3 is compensated since electron beams that are near to the right side of the beam-deflection area 32 (that is near to the electromagnet 10) are given a stronger Lorenz force. In both cases, the distorted beam-deflection area 32 and the distorted raster on the screen can be compensated to be a rectangular shape by controlling the magnetizing current supplied to the electromagnet 10 in accordance with a distortion level of the trapezoid distortion. For example, a variable resistor may be connected to the electromagnet 10 in series or parallel, so that the magnetizing current for the electromagnet 10 is controlled by adjusting the variable resistor.

In FIG. 3, if the direction of the magnetizing current for the electromagnet 10 is changed, the magnetic polarity of the electromagnet 10 is changed so that the north pole is at the lower end and the south pole is at the upper end of the electromagnet 10. In this case, the horizontal combined magnetic field between the electromagnet 10 and the permanent magnets 14 is weakened at the lower and strengthened at the upper of the electromagnet 10, oppositely to FIG. 3. As a result, electron beams at the upper-right area are given a downward (i.e., inward) Lorenz force, so that a trapezoid distortion, in which the upper side rises at the right, can be compensated effectively.

In FIG. 3 again, if both directions of the magnetic poles of the pair of permanent magnets 14 are changed so that the north poles are at the inner ends and the south poles are at the outer ends of the permanent magnets 14, the horizontal combined magnetic field, which is strengthened at the upper or the lower end of the electromagnet 10 in accordance with the polarity of the electromagnet 10, has the leftward direction opposite to FIG. 3. As a result, Lorenz force given to the electron beam has the upward direction opposite to FIG. 3. Thus, a trapezoid distortion, in which the upper side declines at the right or the lower side declines at the right, can be compensated effectively. Though the polarity of the permanent magnet 14 can be changed by resetting the magnet 14 after changing its position by 180 degrees, it can be changed more easily if the permanent magnet 14 is fixed to a holder (not shown in the Figure) that can pivot on the axis perpendicular to the plane of FIG. 3.

Similarly, it can be understood that a trapezoid distortion, in which the lower side rises at the right and the upper side declines at the right, can be compensated if the polarity of the upper permanent magnet 14 is changed without changing the polarity of the lower permanent magnet 14. In this state, if the polarities of the electromagnet 10 and the permanent magnets 14 are changed simultaneously, a trapezoid distortion, in which the upper side rises at the right and the lower side declines at the right, can be compensated effectively.

In the above mentioned embodiment, the electromagnet 10 and the permanent magnets 14 are disposed near the right side of the beam-deflection area 32. However, it may be apparent to a person skilled in the art that the same effect can be obtained if they are disposed near the left side of the beam-deflection area 32. A trapezoid distortion, in which the upper or lower side rises or declines at the right, can be compensated by giving a Lorenz force to the electron beam at upper-left or lower-left area of the beam-deflection area 32, too.

A third embodiment of the compensation device for a raster distortion according to the present invention is shown in FIG. 4. This embodiment of the compensation device further comprises a pair of electromagnets 10' added to the configuration shown in FIG. 2. These electromagnets 10' are disposed between the electromagnet 10 at the center portion of the upper side of the beam-deflection area 33 and the ends of the upper side respectively. The magnetic poles generated by the electromagnets 10, 10' and permanent magnets 14 are substantially aligned in the direction along the upper side. The shape of this beam-deflection area 33 is similar to the raster shape on the screen. In the example shown in FIG. 4, the outer shape of the beam-deflection area 33 is rectangular, but the middle portion 33' of the beam-deflection area 33 including the center vertical axis 12 is distorted to a pincushion shape. Especially, the upper half of the middle portion 33' expands rightward and leftward. Therefore, there is a similar inner pincushion distortion in the raster on the screen.

The ends of the wires 8, 8' of the electromagnets 10, 10' are connected to the driving circuits 7, 7' respectively, which supply a magnetizing current to the electromagnets 10, 10' synchronizing with the vertical deflection current. For example, a saw-tooth wave current, which is similar to the vertical deflection current increasing along with the vertical deflection angle, is supplied to the electromagnets 10, 10'.

As shown in FIG. 4, in the upper half of the beam-deflection area 33, the center electromagnet 10 is magnetized so as to generate the north pole at the right end and the south pole at the left end of the electromagnet 10. The pair of electromagnets 10' are magnetized so as to generate the south pole at the right end and the north pole at the left end of the electromagnet 10'. The pair of permanent magnets 14 disposed beyond the ends of the upper side of the beam deflection area 33 generate south poles at the right ends and north poles at the left ends of the permanent magnets 14.

The electromagnets 10, 10' and permanent magnets 14, which are arranged in the position and the direction mentioned above, generate a vertical combined magnetic field such as shown by a magnetic flux 15 in FIG. 4. This vertical combined magnetic field is strengthened between the center electromagnet 10 and the pair of electromagnets 10', and weakened between the pair of electromagnets 10' and the pair of permanent magnets 14. The vertical combined magnetic field has a downward direction at the right and an upward direction at the left of the center electromagnet 10. Therefore, in the upper half of the beam deflection area 33 as shown in FIG. 4, an electron beam 13 between the center vertical axis 12 and the left side is given a rightward (i.e., inward) Lorenz force, and an electron beam 13' between the center vertical axis 12 and the right side is given a leftward (i.e., inward) Lorenz force 16'. In addition, the magnetizing current supplied to the electromagnets 10, 10' from the driving circuits 7, 7' increases along with the vertical deflection angle as mentioned before. Therefore, the electron beam is given a stronger Lorenz force if the beam is nearer to the upper side of the beam-deflection area 33. As a result, the inner pincushion distortion shown as the area 33' in FIG. 4 as well as a similar horizontal inner distortion of the raster on the screen is compensated adequately.

The magnetizing current, which the driving circuits 7, 7' supplies to the electromagnets 10, 10', is not always required to be the saw-tooth wave current increasing along with the vertical deflection angle, and it may be a direct current as mentioned before. In this case too, the inner pincushion distortion can be compensated adequately by controlling the magnetizing current supplied to the electromagnets 10, 10' in accordance with a distortion level of the inner pincushion distortion. For example, a variable resistor may be connected to the electromagnets 10, 10' in series or parallel, and the magnetizing current for the electromagnets 10, 10' is controlled by adjusting the variable resistor.

Three driving circuits are not always required for three electromagnets 10, 10'. A single driving circuit may supply a magnetizing current to three electromagnets 10, 10'. Three electromagnets 10, 10' may be connected in series or parallel to be supplied with magnetizing current from a single driving circuit.

In FIG. 4, if the magnetic polarity of the left permanent magnet 14 is changed so that the north pole is at the inner end of the magnet 14, a trapezoid distortion with the left side leaning inward can be compensated in accordance with the principle explained before with FIG. 2. In this case, if the inner pincushion distortion does not exist, the magnetic polarity of the center electromagnet 10 is changed to be the same polarity (pole direction) as the pair of electromagnets 10'. From this state, if the polarities of the three electromagnets are changed simultaneously, a trapezoid distortion with the right side leaning outward can be compensated. Further, if the polarities of the pair of permanent magnets 14 are changed simultaneously to generate the south poles at the inner ends and the north poles at the outer ends of the magnets 14, a trapezoid distortion with the left side leaning outward or the right side leaning inward can be compensated effectively as mentioned in the variation of the foregoing embodiment.

As explained above, the compensating device for a raster distortion using three electromagnets and two permanent magnets as shown in FIG. 4 can be used for compensating both of the inner pincushion distortion and the trapezoid distortion by changing the magnetic polarities of the electromagnets and/or the permanent magnets. The inner pincushion distortion can be compensated when the magnetic polarity of the center electromagnet 10 is different from that of the pair of electromagnets 10', and the trapezoid distortion can be compensated when the magnetic polarities of the pair of the electromagnets 10' are different from those of the pair of permanent magnets 14.

A fourth embodiment of the compensation device for a raster distortion according to the present invention is shown in FIG. 5. This embodiment of the compensation device further comprises a pair of electromagnets 10' added to the configuration shown in FIG. 3. These electromagnets 10' are disposed between the electromagnet 10 at the center portion of the right side of the beam-deflection area 34 and the ends of the right side respectively. The magnetic poles generated by the electromagnets 10, 10' and permanent magnets 14 are substantially aligned in the direction along the right side. The shape of this beam-deflection area 34 is similar to the raster shape on the screen. In the example shown in FIG. 5, the outer shape of the beam-deflection area 34 is rectangular, but the middle portion 34' of the beam-deflection area 34 including the center horizontal axis 11 is distorted to a pincushion shape. Especially, the right half of the middle portion 34' expands upward and downward. Therefore, there is a similar inner pincushion distortion in the raster on the screen.

The ends of the wires 8, 8' of the electromagnets 10, 10' are connected to the driving circuits 7, 7' respectively, which supplies a magnetizing current to the electromagnets 10, 10' synchronizing with the horizontal deflection current. For example, a saw-tooth wave current, which is similar to the horizontal deflection current increasing along with the horizontal deflection angle, is supplied to the electromagnets 10, 10'.

As shown in FIG. 5, in the right half of the beam-deflection area 34, the center electromagnet 10 is magnetized so as to generate the north pole at the lower end and the south pole at the upper end of the electromagnet 10. The pair of electromagnets 10' is magnetized so as to generate the south pole at the lower end and the north pole at the upper end of the electromagnets 10'. The pair of permanent magnets 14 disposed beyond the ends of the right side of the beam deflection area 34 generate south poles at the lower ends and north poles at the upper ends of the permanent magnets 14.

The electromagnets 10, 10' and permanent magnets 14, which are arranged in the position and the direction mentioned above, generate a horizontal combined magnetic field such as shown by a magnetic flux 15 in FIG. 5. This horizontal combined magnetic field is strengthened between the center electromagnet 10 and the pair of electromagnets 10', and weakened between the pair of electromagnets 10' and the pair of permanent magnets 14. The horizontal combined magnetic field has a leftward direction under the center electromagnet 10 and a rightward direction above the center electromagnet 10. Therefore, in the right half of the beam deflection area 34 as shown in FIG. 5, an electron beam 13 between the center horizontal axis 11 and the upper side is given a downward (i.e., inward) Lorenz force 16, and an electron beam 13' between the center horizontal axis 11 and the lower side is given an upward (i.e., inward) Lorenz force 16'. In addition, the magnetizing current supplied to the electromagnets 10, 10' from the driving circuits 7, 7' increases along with the horizontal deflection angle as mentioned before. Therefore, the electron beam is given a stronger Lorenz force if the beam is nearer to the right side of the beam-deflection area 34. As a result, the inner pincushion distortion shown as the area 34' in FIG. 5 as well as a similar vertical inner distortion of the raster on the screen is compensated adequately.

The magnetizing current, which the driving circuits 7, 7' supplies to the electromagnets 10, 10', is not always required to be the saw-tooth wave current increasing along with the horizontal deflection angle, and it may be a direct current as mentioned before. In this case too, the inner pincushion distortion can be compensated adequately by controlling the magnetizing current supplied to the electromagnets 10, 10' in accordance with a distortion level of the inner pincushion distortion. For example, a variable resistor may be connected to the electromagnets 10, 10' in series or parallel, and the magnetizing current for the electromagnets 10, 10' is controlled by adjusting the variable resistor.

Three driving circuits are not always required for three electromagnets 10, 10'. A single driving circuit may supply a magnetizing current to the three electromagnets 10, 10'. Three electromagnets 10, 10' may be connected in series or parallel to be supplied with magnetizing current from a single driving circuit.

In FIG. 5, if the magnetic polarity of the lower permanent magnet 14 is changed so that the north pole is at the inner (upper) end of the magnet 14, a trapezoid distortion with the lower side rising at the right can be compensated in accordance with the principle explained before with FIG. 3. In this case, if the inner pincushion distortion does not exist, the magnetic polarity of the center electromagnet 10 is changed to have the same polarity (pole direction) as the pair of electromagnets 10'. From this state, if the polarities of the three electromagnets are changed simultaneously, a trapezoid distortion with the upper side rising at the right can be compensated. Further, if the polarities of the pair of permanent magnets 14 are changed simultaneously to generate the north poles at the inner ends and the south poles at the outer ends of the magnets 14, a trapezoid distortion with the upper or lower side declining at the right can be compensated effectively as mentioned in the variation of the foregoing embodiment.

As explained above, the compensating device for a raster distortion using three electromagnets and two permanent magnets as shown in FIG. 5 can be used for compensating both the inner pincushion distortion and the trapezoid distortion by changing the magnetic polarities of the electromagnets and/or the permanent magnets. The inner pincushion distortion can be compensated when the magnetic polarity of the center electromagnet 10 is different from that of the pair of electromagnets 10' , and the trapezoid distortion can be compensated when the magnetic polarities of the pair of the electromagnets 10' are different from those of the pair of permanent magnets 14.

The compensating device for a raster distortion according to the present invention can compensate a trapezoid distortion and an inner pincushion distortion by a simple and inexpensive configuration including electromagnets and permanent magnets as mentioned above. The inner shield member in the glass bulb is not required to be cut for compensating the inner pincushion distortion as in the prior art.

In the embodiment of the present invention, the compensating device (especially, a set of one or more electromagnet and permanent magnets) is required to be disposed along at least one location of the upper, lower, right and left sides of the deflection yoke. Generally, a raster distortion has a tendency to occur in a same way even if the distortion level is different when using a glass bulb and a deflection yoke in a same production lot. In this case, the compensating device can be disposed along a specific location of the upper, lower, right or left side of the deflection yoke in a same production lot. Thus, most raster distortions can be compensated by controlling the magnetizing current for the electromagnet as mentioned before.

The invention may be embodied in other specific forms without departing from the spirit or essential characteristics thereof. The embodiments disclosed in this application are to be considered in all respects as illustrative and not restrictive, the scope of the invention being indicated by the appended claims rather than by the foregoing description, and all changes that come within the meaning and range of equivalency of the claims are intended to be embraced therein.

I claim:

1. A compensating device for raster distortion in a cathode-ray tube apparatus, said device comprising:

an electromagnet disposed between a screen-side edge and a gun-side edge of a deflection yoke and disposed at a center portion of at least one of an upper side, a lower side, a right side and a left side of a substantially rectangular section of a beam-deflection area that is located between the screen-side edge and the gun-side edge of the deflection yoke, and defined by a path of deflection of an electron-beam, said electromagnet generating magnetic poles in the direction along the side on which the electromagnet is disposed, said electromagnet having a shorter length than a length of the upper, lower, right and left sides of the beam-deflection area;

a driver for said electromagnet; and a pair of permanent magnets disposed beyond ends of said side of the deflection area, having magnetic poles aligned substantially with said magnetic poles of said electromagnet.

2. The compensating device according to claim 1, wherein said electromagnet is disposed at a center portion of at least one of the upper and lower sides of said substantially rectangular section of a beam-deflection area, and said driver provides said electromagnet with a current synchronizing with a vertical deflection current.

3. The compensating device according to claim 1, wherein said electromagnet is disposed at a center portion of at least one of the right and left sides of said substantially rectangular section of a beam-deflection area, and said driver provides said electromagnet with a current synchronizing with a horizontal deflection current.

4. The compensating device according to claim 1, wherein said driver can change the direction of the current supplied to said electromagnet so that a polarity of said electromagnet is reversible.

5. The compensating device according to claim 1, wherein polarities of said permanent magnets are reversible.

6. The compensating device according to claim 1, further comprising a plurality of electromagnets disposed between said electromagnet at the center portion of said side and ends of said side, magnetic poles of said electromagnets and said permanent magnets being aligned substantially.

7. The compensating device according to claim 6, wherein said electromagnets are disposed along at least one of the upper and lower sides of said substantially rectangular section of the beam-deflection area, and said driver provides said electromagnets with currents synchronizing with the vertical deflection current.

8. The compensating device according to claim 6, wherein said electromagnets are disposed along at least one of the right and left sides of said substantially rectangular section of the beam-deflection area, and said driver provides said electromagnets with currents synchronizing with the horizontal deflection current.

9. The compensating device according to claim 6, wherein said driver can change the direction of the currents supplied to said electromagnets, so that polarities of said electromagnets are reversible.

10. The compensating device according to claim 6, wherein polarities of said permanent magnets are reversible.

11. A deflection yoke comprising a compensating device according to claim 1; a horizontal deflection coil; a vertical deflection coil disposed around said horizontal deflection coil; a magnetic core disposed around said vertical coil; and said compensating device disposed outside of said magnetic core.

12. A cathode-ray tube apparatus, comprising a compensating device according to claim 1; a neck portion housing an electron gun; a funnel portion extending from said neck portion; a face panel portion connected to said funnel portion so as to close the opening of said funnel portion, said face panel portion having a phosphor screen on the inner surface; a deflection yoke disposed around the boundary of said neck portion and said funnel portion; and said compensating device disposed outside of said deflection yoke.

* * * * *